US007566143B2

(12) United States Patent
Furukawa et al.

(10) Patent No.: US 7,566,143 B2
(45) Date of Patent: Jul. 28, 2009

(54) BACKLIGHT APPARATUS AND COLOR IMAGE DISPLAY APPARATUS

(75) Inventors: Norimasa Furukawa, Tokyo (JP); Mitsunari Hoshi, Miyagi (JP); Yoshihiro Katsu, Kanagawa (JP); Mitsuru Okabe, Tokyo (JP)

(73) Assignee: Sony Corporation (JP)

( * ) Notice: Subject to any disclaimer, the term of this patent is extended or adjusted under 35 U.S.C. 154(b) by 234 days.

(21) Appl. No.: 11/807,590

(22) Filed: May 29, 2007

(65) Prior Publication Data

US 2007/0297172 A1 Dec. 27, 2007

(30) Foreign Application Priority Data

May 30, 2006 (JP) ..... P2006-150415
Apr. 17, 2007 (JP) ..... P2007-108501

(51) Int. Cl.
*F21S 2/00* (2006.01)
*G09G 3/12* (2006.01)
*F21V 9/00* (2006.01)

(52) U.S. Cl. ..... 362/231; 362/602; 362/234; 362/276; 345/83; 345/88; 345/102

(58) Field of Classification Search ..... 362/602, 362/612, 613, 276; 345/83, 88, 102
See application file for complete search history.

(56) References Cited

U.S. PATENT DOCUMENTS

2005/0184952 A1 8/2005 Konno et al.
2006/0022935 A1 2/2006 Sakai et al.
2006/0125773 A1* 6/2006 Ichikawa et al. ..... 345/102
2007/0064422 A1* 3/2007 Murai ..... 362/231

FOREIGN PATENT DOCUMENTS

JP 2001-142409 A 5/2001
JP 2005-258403 A 9/2005
JP 2006-040764 A 2/2006

* cited by examiner

*Primary Examiner*—Stephen F Husar
*Assistant Examiner*—James W Cranson
(74) *Attorney, Agent, or Firm*—Lerner, David, Littenberg, Krumholz & Mentlik, LLP

(57) ABSTRACT

Herein disclosed a backlight apparatus for illuminating a color display panel from the back side, which may include a light source section having a composite light source, a light detecting light introducing plate, a plurality of light amount sensors for the individual colors, and control means.

15 Claims, 14 Drawing Sheets

BACKLIGHT APPARATUS AND COLOR IMAGE DISPLAY APPARATUS

CROSS-REFERENCE TO RELATED APPLICATIONS

This application claims priority from Japanese Patent Application No. JP 2006-150415 filed in the Japanese Patent Office on May 30, 2006 and Japanese Patent Application No. JP 2007-108501 filed in the Japanese Patent Office on Apr. 17, 2007, the entire contents of which are incorporated herein by reference.

BACKGROUND OF THE INVENTION

1. Field of the Invention

This invention relates to a backlight apparatus and a color image display apparatus wherein a color display panel is illuminated from the back side.

2. Description of the Related Art

Very thin television receivers formed using a liquid crystal display (LCD) or a plasma display panel (PDP) in place of a cathode ray tube (CRT) which has been used for long years after television broadcasting was started have been proposed and placed into practical use. Particularly, a liquid crystal display apparatus which uses a liquid crystal display panel is advantageous in that it can be driven with low power consumption and can be formed as a large size display unit. Therefore, the liquid crystal display apparatus is estimated to be popularized progressively together with reduction of the price of a large size liquid crystal display panel, and further development in future of the liquid crystal display apparatus is anticipated.

Among color liquid crystal display apparatus, a color liquid crystal apparatus of the backlight type wherein a transmission type color liquid crystal display panel having color filters is illuminated from the back side by a backlight apparatus to display a color image has become the main current. For the light source of the backlight apparatus, a fluorescent lamp such as a cold cathode florescent lamp (CCFL) which uses a fluorescent tube to emit white light is used frequently.

Since the CCFL uses mercury enclosed in the fluorescent tube, it may possibly have a bad influence on the environment. Therefore, a light emitting diode (LED) is estimated hopeful as the light source for a backlight apparatus in place of the CCFL as disclosed, for example, in Japanese Patent Laid-Open No. 2001-142409 (hereinafter referred to as Patent Document 1).

As a result of development of a blue light emitting diode, light emitting diodes which emit red light, green light and blue light of the primary colors of light have become complete. By mixing red light, green light and blue light emitted from the light emitting diodes, white light having high purity of white can be obtained. Accordingly, where the light emitting diodes are used as a light source for a backlight apparatus, after the light from the light source passes through the liquid crystal display panel, resulting color light has high color purity. Therefore, the color reproduction range can be widened significantly when compared with that by the CCFL.

For the light emitting diodes to be used as a light source for a backlight apparatus, light emitting diodes which use a light emitting diode (LED) chip of a high output are used effectively. Where light emitting diodes of the type mentioned are used, the luminance of the backlight apparatus can be enhanced significantly.

Incidentally, in a color liquid crystal display apparatus of the backlight type, a color liquid crystal display panel upon which prescribed white light is illuminated from the back side by a backlight apparatus shades the white light to extract only light of an object color component for each pixel by means of color filters to display a color image.

In particular, from within the white light emitted from the backlight apparatus, only light of an object color component extracted through the color liquid crystal display panel is utilized. For example, in order to display the entire screen in red, the color liquid crystal display panel shades the white light at those pixels other than pixels for which the red filter is provided, that is, at those pixels for which the green filter and the blue filter are provided. Therefore, light of the pixels other than the pixels for which the red filter is provided is not utilized.

In this manner, in existing color liquid crystal display apparatus of the backlight type, since white light including color components which are not utilized is emitted from the backlight apparatus, power is consumed uselessly as much.

Therefore, the assignee of the present invention has proposed, in Patent Document 1 mentioned above, an apparatus and method wherein a backlight panel is driven in a unit of a divisional region from among a plurality of divisional regions and the luminance of the backlight is controlled in response to an image signal to reduce the power consumption.

SUMMARY OF THE INVENTION

Incidentally, where a backlight apparatus is driven in a unit of a divisional region from among a plurality of divisional regions and the luminance of the backlight is controlled in response to an image signal, since the driving condition is different among different divisional regions, if the light amount balance is displaced among the divisional regions, then the displacement among the divisional regions appears as irregularities in color of a display image.

Therefore, it may be demanded to provide a backlight apparatus wherein, where it is driven in a unit of a divisional region from among a plurality of divisional regions, appearance of irregularities in color of a display image caused by displacement in the light amount balance among the divisional regions is prevented.

Also it may be demanded to provide a color image display apparatus wherein, where it includes a color display panel and a backlight apparatus for illuminating the color display panel from the back side and the backlight apparatus is driven in a unit of a divisional region from among a plurality of divisional regions, appearance of irregularities in color of a display image caused by displacement in the light amount balance among the divisional regions is prevented.

According to an embodiment of the present invention, there is provided a backlight apparatus for illuminating a color display panel from the back side, which may include a light source section having a composite light source configured to mix light fluxes of different colors from a plurality of monochromatic light sources and irradiate the mixed light upon the color display panel and having a plurality of optical regions grouped for each arbitrary number of the monochromatic light sources, a light detecting light introducing plate in the form of an optically transparent elongated plate disposed so as to traverse the optical regions of the light source section and having at least one light pickup portion provided thereon corresponding to each of the optical regions, a plurality of light amount sensors for the individual colors provided at least on one of the opposite end faces of the light detecting light introducing plate in the longitudinal direction, and control means for successively detecting the light in the individual optical regions using the color light sensors for the individual colors and controlling the light amount balance of the light of the colors emitted from the monochromatic light sources grouped for the individual optical regions based on detection outputs of the light amount sensors for the colors.

According to another embodiment of the present invention, there is provided a color image display apparatus having a color display panel, and a backlight apparatus configured to illuminate the color display panel from the back side, the backlight apparatus may include a light source section which may include a composite light source configured to mix light fluxes of different colors from a plurality of monochromatic light sources and irradiate the mixed light upon the color display panel and having a plurality of optical regions grouped for each arbitrary number of the monochromatic light sources, a light detecting light introducing plate in the form of an optically transparent elongated plate disposed so as to traverse the optical regions of the light source section and having at least one light pickup portion provided thereon corresponding to each of the optical regions, a plurality of light amount sensors for the individual colors provided at least on one of the opposite end faces of the light detecting light introducing plate in the longitudinal direction, and control means for successively detecting the light in the individual optical regions using the color light sensors for the individual colors and controlling the light amount balance of the light of the colors emitted from the monochromatic light sources grouped for the individual optical regions based on detection outputs of the light amount sensors for the colors.

With the backlight apparatus and the color image display apparatus, when the backlight apparatus is driven in a unit of each of a plurality of divisional regions, appearance of irregularities in color of a display image caused by displacement of the light amount balance among the divisional regions can be prevented.

The above and other features and advantages of the present invention will become apparent from the following description and the appended claims, taken in conjunction with the accompanying drawings in which like parts or elements denoted by like reference symbols.

DETAILED DESCRIPTION

Figure 1:
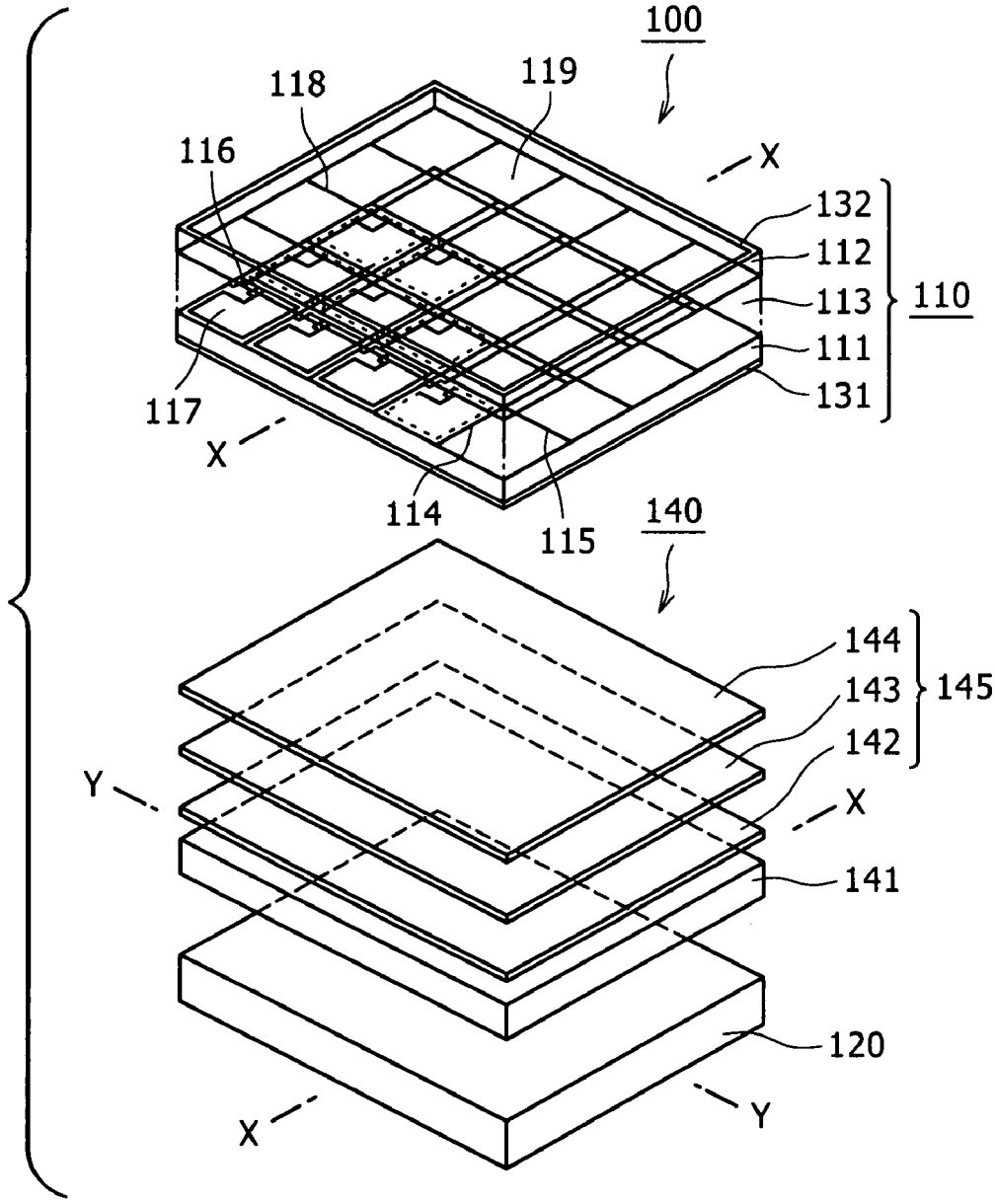
FIG. 1 is an exploded perspective view showing a configuration of a color image display apparatus to which the present invention is applied.

Referring first to FIG. 1, there is shown a color image display apparatus 100 to which an embodiment of the present invention is applied.

The color image display apparatus 100 shown is a color liquid crystal display apparatus of the transmission type and includes a color liquid crystal display panel 110 of the transmission type and a backlight apparatus 140 provided on the back side of the color liquid crystal display panel 110. Further, though not shown, the color image display apparatus 100 may further include a receiver section such as an analog tuner or a digital tuner for receiving a ground wave or a satellite wave, an image signal processing section and a sound signal processing section for processing an image signal and a sound signal received by the receiver section, respectively, a sound signal outputting section such as a speaker for outputting the sound signal processed by the sound signal processing section, and so forth.

The transmission type color liquid crystal display panel 110 of the color image display apparatus 100 includes two transparent substrates including a TFT (Thin Film Transistor) substrate 111 and an opposing electrode substrate 112 made of glass or a like material and disposed in an opposing relationship to each other. The transmission type color liquid crystal display panel 110 further includes a liquid crystal layer 113 disposed in a gap formed between the TFT substrate 111 and the opposing electrode substrate 112 and having, for example, twisted nematic (TN) liquid crystal enclosed therein. The color liquid crystal display panel 110 further includes two polarizing plates 131 and 132 between which the TFT substrate 111 and the opposing electrode substrate 112 are sandwiched. Signal lines 114 and scanning lines 115 arrayed in a matrix, thin film transistors 116 arrayed at intersecting points of the signal lines 114 and the scanning lines 115 and serving as switching elements, and pixel electrodes 117 are formed on the TFT substrate 111. The thin film transistors 116 are successively selected by the scanning lines 115 and write image signals supplied from the signal lines 114 into the corresponding pixel electrodes 117. Meanwhile, opposing electrodes 118 and a color filter 119 are formed on the inner surface of the opposing electrode substrate 112.

Figure 2:
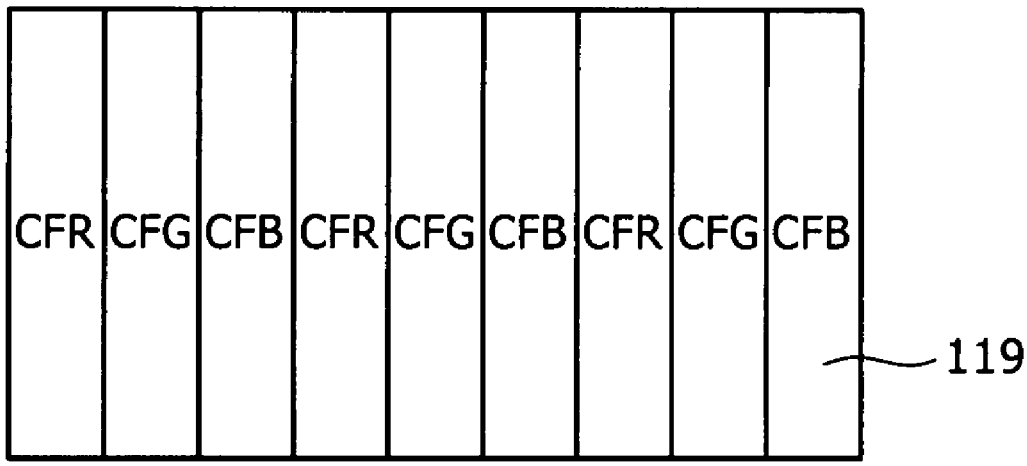
FIG. 2 is a schematic view showing color filters provided in a liquid crystal display panel of the color image display apparatus.

The color filter 119 is divided into a plurality of segments corresponding to the pixels. For example, the color filter 119 is divided into three different kinds of segments of red filters CFR, green filters CFG and blue filters CFB for the three primary colors as seen in FIG. 2. The array pattern of the color filter 119 may be such a stripe array as seen in FIG. 2, or a delta array or a tetragonal array.

In the color liquid crystal display panel 110, the thin film transistors arranged in a matrix are controlled to selectively apply a voltage to the liquid crystal layer 113 independently for the individual pixels so that incoming light is optically modulated to effect image display.

The color image display apparatus 100 can display a desired full color image by driving the color liquid crystal display panel 110 of the transmission type having such a configuration as described above in accordance with an active matrix system in a state in which white light is illuminated on the color image display apparatus 100 from the back side by the backlight apparatus 140.

The backlight apparatus 140 of the color image display apparatus 100 is formed as a backlight apparatus of the area light type which uses a large number of light emitting diodes. In particular, the backlight apparatus 140 includes, as seen in FIG. 1, a diffusion plate 141 and an optical sheet group 145 disposed in an overlapping relationship on the diffusion plate 141 and including a diffusion sheet 142, a prism sheet 143 and a polarization conversion sheet 144. The diffusion plate 141 and the optical sheet group 145 are provided in a housing section 120 in which a large number of light emitting diodes are disposed as a light source. The diffusion plate 141 internally diffuses light emitted from the light source to uniformize the luminance in planar light emission. The optical sheet group 145 deflects illumination light emitted from the diffusion plate 141 toward a normal direction to the diffusion plate 141 to raise the luminance in planar light emission.

Figure 3:
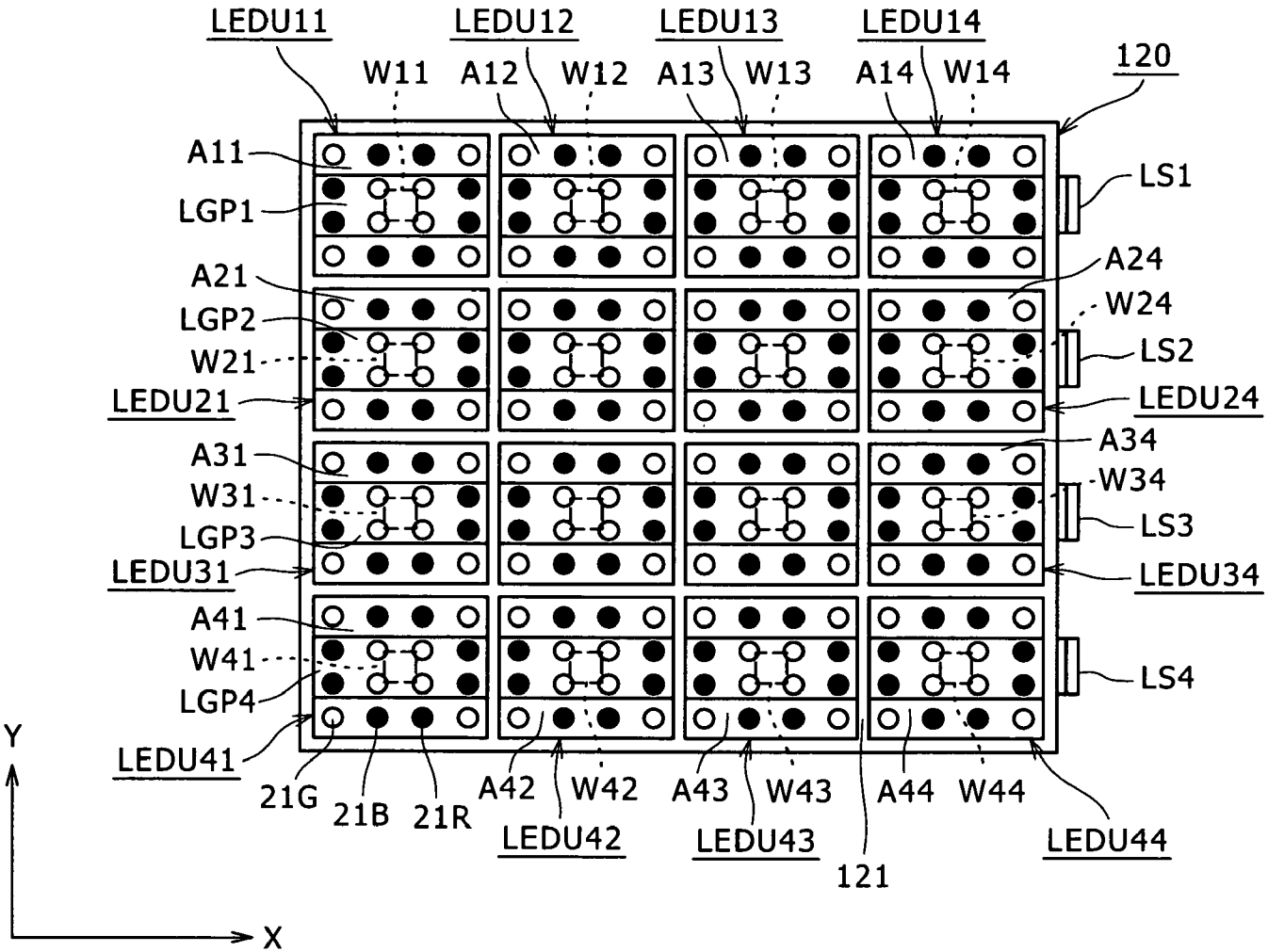
FIG. 3 is a schematic view showing a general internal configuration of a housing section of a backlight apparatus of the color image display apparatus.

An internal general configuration of the housing section 120 of the backlight apparatus 140 is shown in FIG. 3. Referring to FIG. 3, the housing section 120 includes light emitting diode units LEDU11 to LEDU44 provided in regions A11 to A44 optically separated from each other in a 4×4 matrix by partition walls 121. Each of the light emitting diode units LEDU11 to LEDU44 includes at least a red light emitting diode 21R for emitting red (R) light, a green light emitting diode 21G for emitting green (G) light and a blue light emitting diode 21B for emitting blue (B) light as a light source. The housing section 120 further includes a light detecting light introducing plate LGP1 in the form of an elongated plate extending in a horizontal direction (X direction) through the partition walls 121 along the regions A11 to A14, and another light detecting light introducing plate LGP2 in the form of an elongated plate extending in the horizontal direction (x direction) through the partition walls 121 along the regions A21 to A24. The housing section 120 further includes a light detecting light introducing plate LGP3 in the form of an elongated plate extending through the partition walls 121 in the horizontal direction (X direction) along the regions A31 to A34, and a light detecting light introducing plate LGP4 in the form of an elongated plate extending in the horizontal direction (x direction) through the partition walls 121 along the regions A41 to A44.

The light detecting light introducing plates LGP1 to LGP4 are made of an optically transparent resin material such as an acrylic resin. At least one light pickup portion W11 to W44 is provided corresponding to each of the regions A11 to A44, and light amount sensor sections LS1 to LS4 each including light amount sensors for the individual lights are provided on at least one of the opposite ends in the longitudinal direction of the light detecting light introducing plates LGP1 to LGP4.

Figure 4:
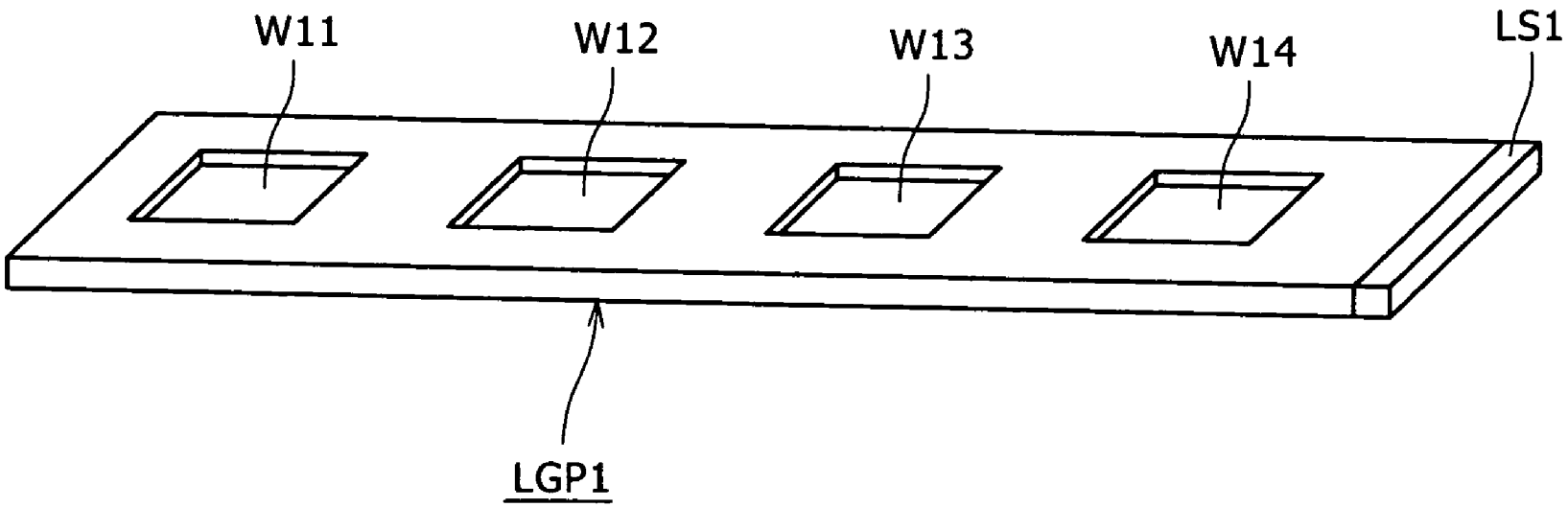
FIG. 4 is a perspective view showing an example of the shape of a light pickup portion of a light detecting light introducing plate provided in the backlight apparatus.

Each of the light pickup portions W (W11 to W44) has an upright face which is provided in an intersecting relationship with the longitudinal direction of a light detecting light introducing plate LGP (LGP1 to LGP4) and does not satisfy an angular condition for the total reflection. The light pickup portion W is formed, for example, in a concave shape as seen from the light pickup portions W11 to W14 of the light detecting light introducing plate LGP1 of FIG. 4.

Figure 5:
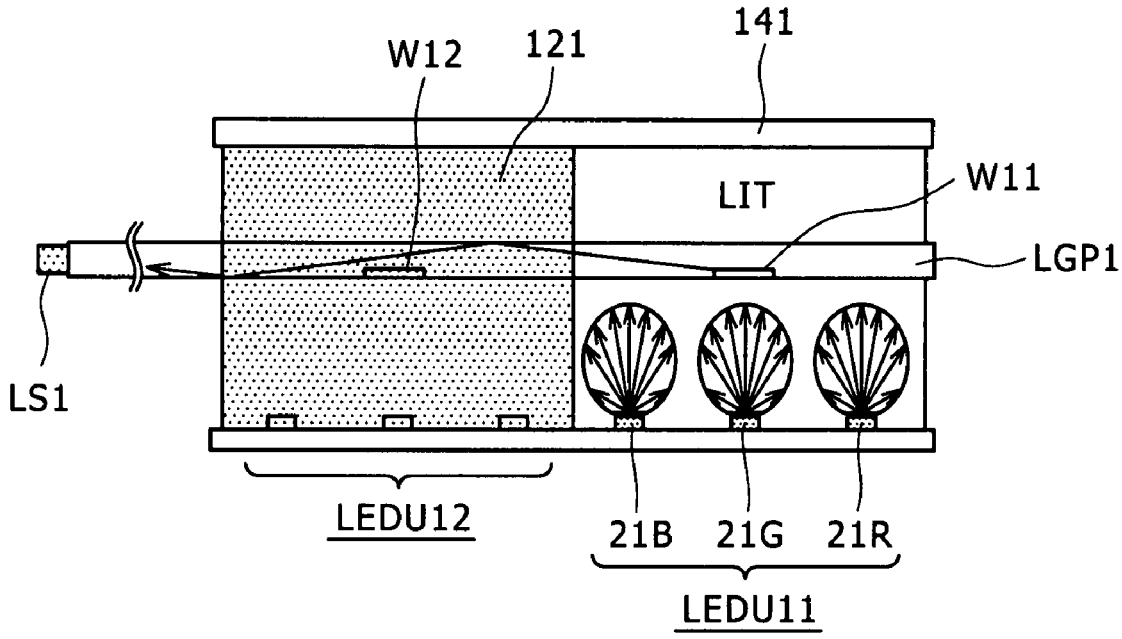
FIG. 5 is a partial vertical sectional view schematically illustrating a function of the light detecting light introducing plate.

In the backlight apparatus 140, the light detecting light introducing plates LGP1 to LGP4 pick up light from the light emitting diode units LEDU11 to LEDU44 provided in the regions A11 to A44 through the light pickup portions W11 to W44 corresponding to the regions A11 to A44 and introduce the picked up light to the light amount sensor sections LS1 to LS4 provided at one end in the longitudinal direction. In the light amount sensor sections LS1 to LS4, the light emitting diode units LEDU11 to LEDU44 are individually turned on so that they can individually detect the light from the light emitting diode units LEDU11 to LEDU44, respectively, as seen in FIG. 5.

Each of the light amount sensor sections LS1 to LS4 includes a red light sensor SR for detecting the amount of red light, a green light sensor SG for detecting the amount of green light, and a blue light sensor SB for detecting the amount of blue light.

Figure 6:
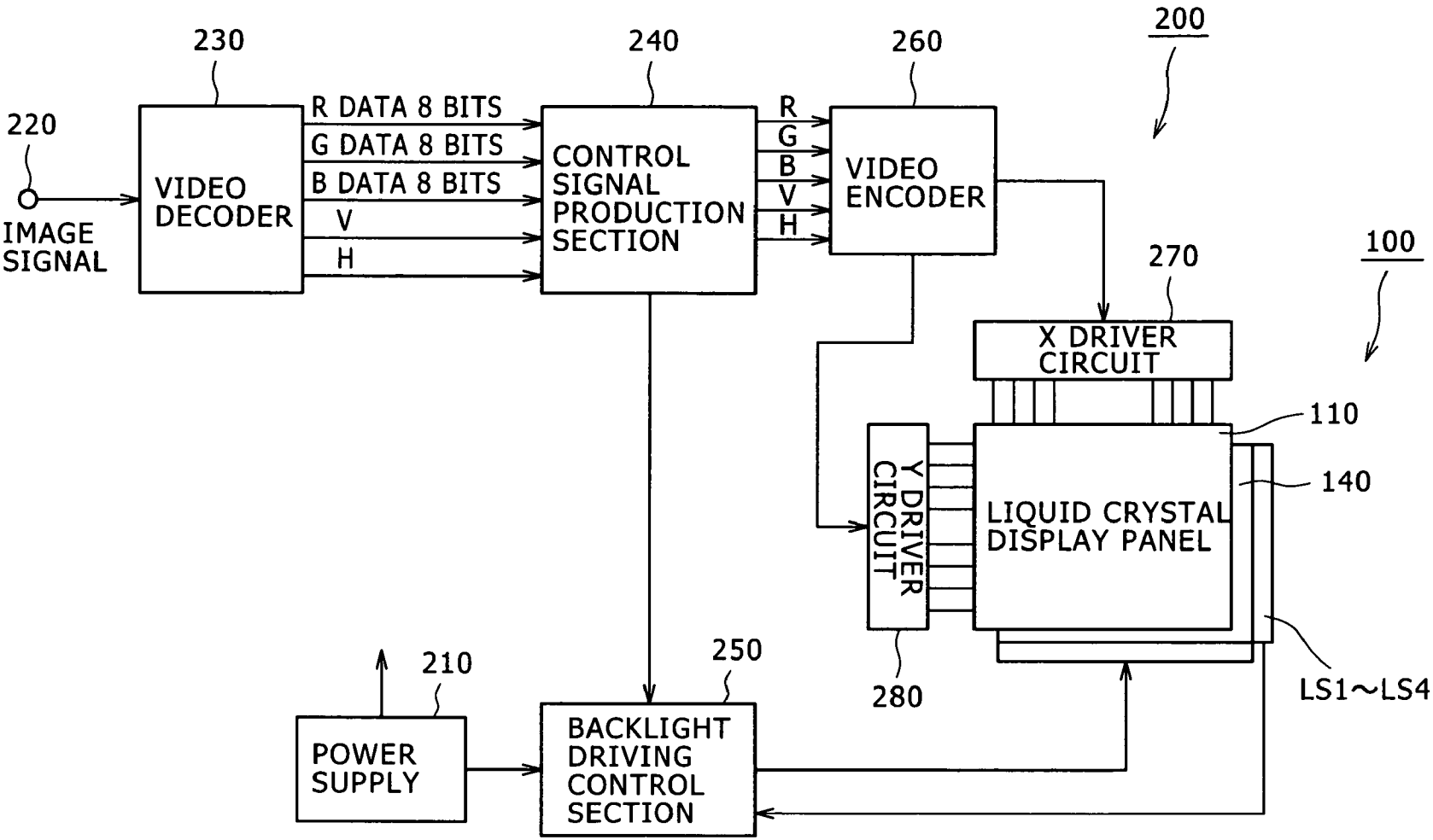
FIG. 6 is a block diagram showing a configuration of a drive circuit of the color liquid crystal display apparatus.

The color image display apparatus 100 having such a configuration as described above is driven, for example, by such a drive circuit 200 as shown in FIG. 6.

Referring to FIG. 6, the drive circuit 200 includes a power supply section 210 for supplying driving power for the color liquid crystal display panel 110 or the backlight apparatus 140, and a video decoder 230 to which an image signal supplied from the outside or an image signal received by the receiver section not shown provided in the color image display apparatus 100 is supplied through an input terminal 220. The drive circuit 200 further includes a control signal production section 240 connected to the video decoder 230, a backlight driving control section 250 and a video encoder 260 connected to the control signal production section 240, and an X driver circuit 270 and a Y driver circuit 280 for driving the color liquid crystal display panel 110 in response to an output of the video encoder 260.

In the drive circuit 200, an image signal inputted through the input terminal 220 is subject to signal processes such as a chroma process by the video decoder 230 and is then converted into of RGB data of m bits (m may be 8 to 12) suitable to drive the color liquid crystal display panel 110 from a composite signal. The RGB data is supplied to the control signal production section 240 together with a horizontal synchronizing signal H and a vertical synchronizing signal V.

The control signal production section 240 produces image signal data based on the RGB data supplied from the video decoder 230 and supplies the produced image signal data to the video encoder 260 together with the horizontal synchronizing signal H and the vertical synchronizing signal V. Further, the backlight driving control section 250 produces light amount control signals for controlling driving of the light emitting diode units LEDU11 to LEDU44 of the backlight apparatus 140 individually in response to the brightness of the image signal and supplies the produced light amount control signal to the backlight driving control section 250.

To the backlight driving control section 250, light amount detection signals produced by successively detecting the amounts of light from the light emitting diode units LEDU11 to LEDU44 by the light amount sensor sections LS1 to LS4 are supplied.

The backlight driving control section 250 controls the light emission amounts of the light emitting diode units LEDU11 to LEDU44 in accordance with light amount control signals corresponding to the brightness of the image signal supplied from the control signal production section 240 thereby to control the brightness of the regions A11 to A44. Further, the backlight driving control section 250 controls the magnitude of driving current to be supplied to the light emitting diodes 21R, 21G and 21B of the individual colors of the light emitting diode units LEDU11 to LEDU44 based on the light amount detection signals detected by the light amount sensor sections LS1 to LS4 thereby to control the light amount balance of the colors.

Figure 7:
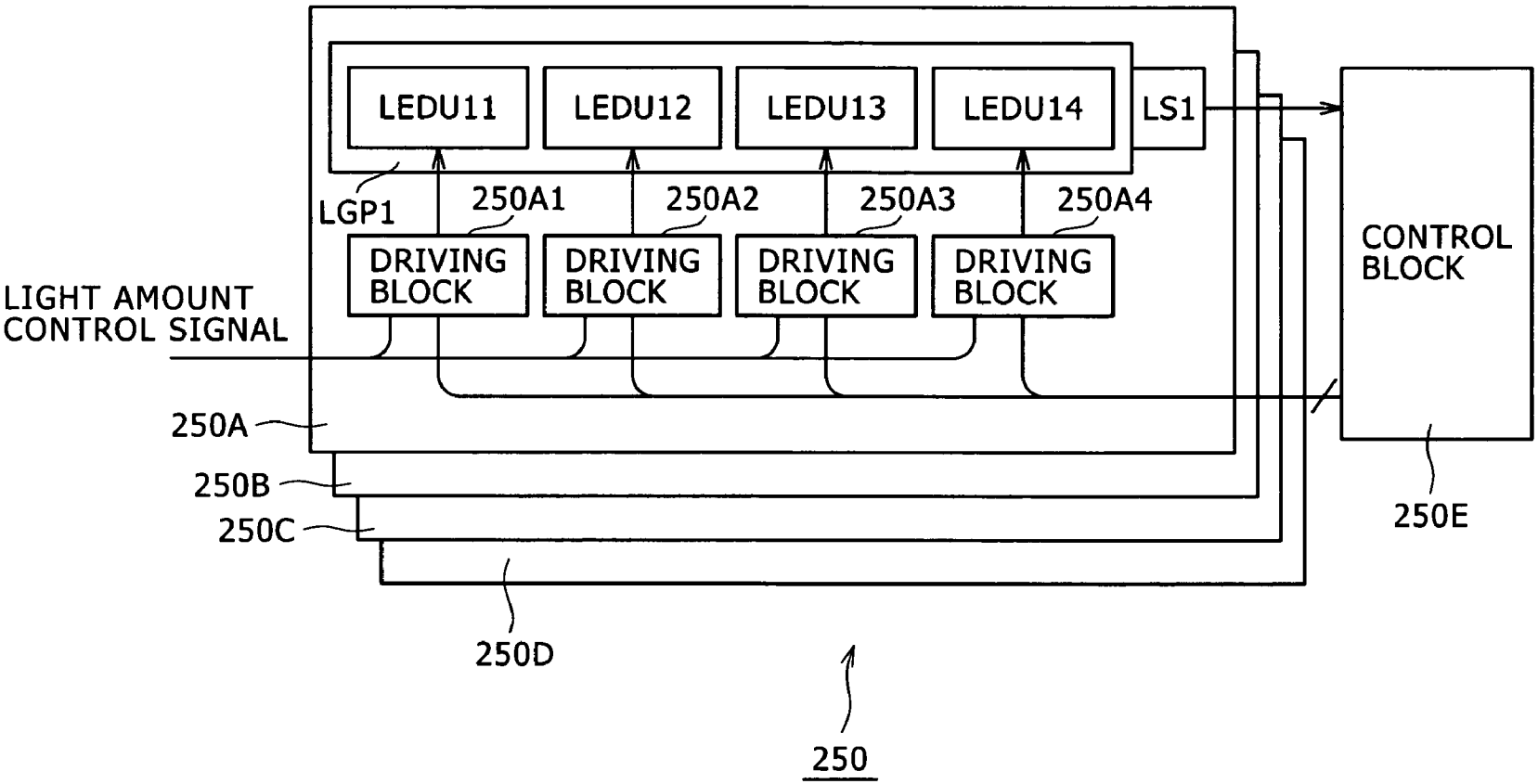
FIG. 7 is a block diagram showing a configuration of a backlight driving control section of the drive circuit.

The backlight driving control section 250 has, for example, such a configuration as shown in FIG. 7. Referring to FIG. 7, the backlight driving control section 250 shown includes a driving block 250A for driving the light emitting diode units LEDU11 to LEDU14, a driving block 250B for driving the light emitting diode units LEDU21 to LEDU24, and a driving block 250C for driving the light emitting diode units LEDU31 to LEDU34. The backlight driving control section 250 further includes a driving block 250D for driving the light emitting diode units LEDU41 to LEDU44, and a control block 250E for controlling operation of the driving blocks 250A to 250D based on light amount detection signals detected by the light amount sensor sections LS1 to LS4.

The backlight driving control section 250 drives the light emitting diode units LEDU11 to LEDU44 for each light emitting diode unit, and the driving block 250A includes driving blocks 250A1 to 250A4 for driving the light emitting diode units LEDU11 to LEDU14, respectively.

Figure 8:
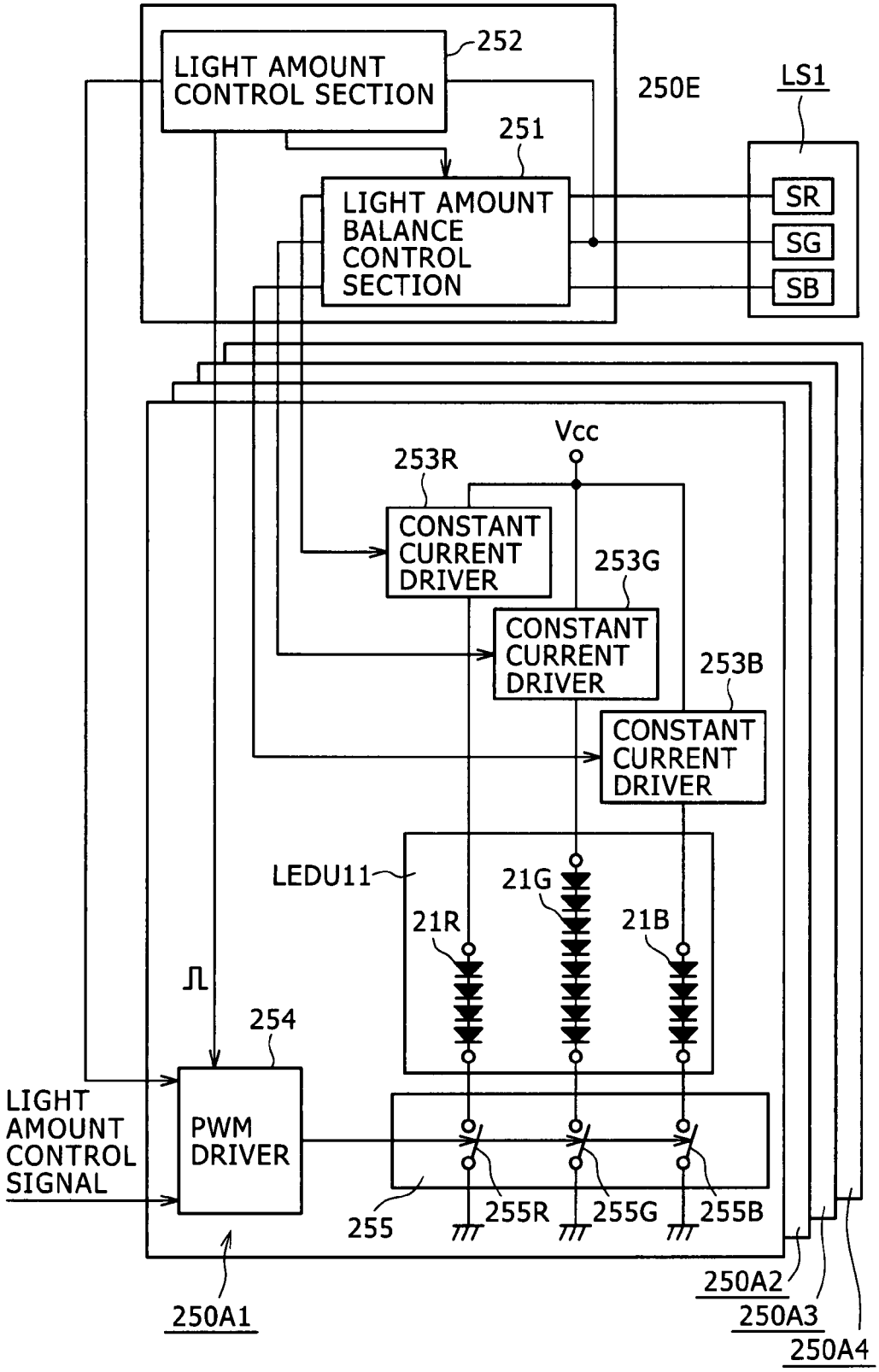
FIG. 8 is a block diagram showing a configuration of a driving block of the backlight driving control section.

The driving block 250A1 has, for example, such a configuration as shown in FIG. 8 and controls the light emitting diode unit LEDU11.

Referring to FIG. 8, the control block 250E includes a light amount balance control section 251 to which color amount detection signals of the colors from the red light sensor SR, green light sensor SG and blue light sensor SB of the light amount sensor section LS1 which detects the amount of light from the light emitting diode unit LEDU11 are supplied. The control block 250E further includes a light amount control section 252 to which the light amount detection signal of green from the green light sensor SG is supplied. The driving block 250A1 of the light emitting diode unit LEDU11 includes constant current drivers 253R, 253G and 253B connected to the light amount balance control section 251, a PWM driver 254 connected to the light amount control section 252, and a PWM switch circuit 255 controlled by the PWM driver 254.

The PWM switch circuit 255 includes PWM switches 255R, 255G and 255B for PWM driving the light emitting diodes 21R, 21G and 21B of the colors connected in series, respectively, and composing the light emitting diode unit LEDU11 provided corresponding to the region A11.

The constant current driver 253R, the red light emitting diode 21R which composes the light emitting diode unit LEDU11, and the PWM switch 255R are connected in series. Meanwhile, the constant current driver 253G, the green light emitting diode 21G which composes the light emitting diode unit LEDU11, and the PWM switch 255G are connected in series. Further, the constant current driver 253B, the blue light emitting diode 21B which composes the light emitting diode unit LEDU11 and the PWM switch 255B are connected in series.

The light amount balance control section 251 produces a light amount balance control signal, for example, for making the light amount of green and the light amount of red and blue coincide with each other based on light amount detection signals from the red light sensor SR, green light sensor SG and blue light sensor SB of the light amount sensor section LS1. Then, the light amount balance control section 251 controls the constant current drivers 253R, 253G and 253B of the driving block 250A1 in accordance with the light amount balance signal to control driving current to be supplied to the light emitting diodes 21R, 21G and 21B of the colors which compose the light emitting diode unit LEDU11. The light amount balance of the light emitting diode unit LEDU11 is controlled thereby.

Meanwhile, the light amount control section 252 produces a light amount control signal indicative of the light emission amount of the entire light emitting diode unit LEDU11 based on the light amount detection signal of green from the green light sensor SG, and supplies the produced light amount control signal to the PWM driver 254 of the driving block 250A1. Then, the PWM driver 254 receives the light amount control signal produced by the control signal production section 240 and produces a PWM control signal of a duty ratio for assuring the brightness necessary for the region A11 in which the light emitting diode unit LEDU11 is provided corresponding to an image displayed by driving of the transmission type color liquid crystal display panel 110 based on the light amount control signal from the light amount control section 252 and the light amount control signal from the control signal production section 240. Then, the PWM driver 254 controls the PWM switches 255R, 255G and 255B of the PWM switch circuit 255 in accordance with the produced PWM control signal. The light amount of the light emitting diode unit LEDU11 is PWM controlled such that the brightness necessary for the region A11 may be assured corresponding to the image displayed by driving of the color liquid crystal display panel 110.

Meanwhile, the driving blocks 250A2 to 250A4 which drive the light emitting diode units LEDU12 to LEDU14 of the driving block 250A are controlled by the light amount balance control section 251 and the light amount control section 252 of the control block 250E based on light amount detection signals of the colors from the red light sensor SR, green light sensor SG and blue light sensor SB of the light amount sensor section LS1 similarly as in the driving block 250A1. Consequently, the light amount balance of the light emitting diode units LEDU12 to LEDU14 is controlled by the light amount balance control section 251, and the light amounts of the light emitting diode units LEDU12 to LEDU14 are PWM controlled by the light amount control section 252 based on the light amount detection signal of green from the green light sensor SG.

Here, when the control block 250E drives operation of the driving block 250A based on the light amount detection signals of the colors from the red light sensor SR, green light sensor SG and blue light sensor SB of the light amount sensor section LS1, the control block 250E supplies control pluses from the light amount control section 252 to the PWM drivers 254 of the driving blocks 250A1 to 250A4, which drive the light emitting diode units LEDU11 to LEDU14 of the driving block 250A, so that the light emitting diode units LEDU11 to LEDU14 are selectively and alternatively driven such that only one light emitting diode unit is placed into a light emitting state while the other light emitting diode units are placed into a no-light emitting state for a period of time within which no influence is had on the sense of sight, for example, for approximately 1/1000 second to perform detection of the light amount for each light emitting diode unit. It is to be noted that the order and the timing when one of the light emitting diode units LEDU11 to LEDU14 is placed into a light emitting state may be determined arbitrarily.

Further, the driving blocks 250A2 to 250A4 which drive the light emitting diode units LEDU21 to LEDU44 of the driving block 250A are controlled by the light amount balance control section 251 and the light amount control section 252 of the control block 250E based on the light amount detection signals of the colors from the red light sensor SR, green light sensor SG blue light sensor SB of the light amount sensor sections LS2 to LS4 similarly as in the driving block 250A1. Consequently, the light amount balance of the light emitting diode units LEDU21 to LEDU44 is controlled by the light amount balance control section 251 of the control block 250E, and the light amounts of the light emitting diode units LEDU21 to LEDU44 are PWM controlled by the light amount control section 252.

Here, when the control block 250E drives operation of the driving block 250A based on the light amount detection signals of the colors from the red light sensor SR, green light sensor SG and blue light sensor SB of the light amount sensor section LS1, the control block 250E supplies control pluses from the light amount control section 252 to the PWM drivers 254 of the driving blocks 250A1 to 250A4, which drive the light emitting diode units LEDU11 to LEDU14 of the driving block 250A, so that the light emitting diode units LEDU11 to LEDU14 are selectively and alternatively driven such that only one light emitting diode unit is placed into a light emitting state while the other light emitting diode units are placed into a no-light emitting state for a period of time within which no influence is had on the sense of sight to perform detection of the light amount for each light emitting diode unit. Then, the light amount balance of the light emitting diode units LEDU11 to LEDU14 is controlled by the light amount balance control section 251.

Similarly, when the control block 250E drives operation of the driving block 250B based on the light amount detection signals of the colors from the red light sensor SR, green light sensor SG and blue light sensor SB of the light amount sensor section LS2, the control block 250E supplies control pluses from the light amount control section 252 to the PWM drivers of the driving blocks, which drive the light emitting diode units LEDU21 to LEDU24 of the driving block 250B, so that the light emitting diode units LEDU21 to LEDU24 are selectively and alternatively driven such that only one light emitting diode unit is placed into a light emitting state while the other light emitting diode units are placed into a no-light emitting state for a period of time within which no influence is had on the sense of sight to perform detection of the light amount for each light emitting diode unit. Then, the light amount balance of the light emitting diode units LEDU21 to LEDU24 is controlled by the light amount balance control section 251.

Further, the control block 250E performs similar detection operation also by the red light sensor SR, green light sensor SG and blue light sensor SB of the light amount sensor section LS3 to control the light amount balance of the light emitting diode units LEDU31 to LEDU44 by means of the light amount balance control section 251.

In other words, the color image display apparatus 100 according to the present embodiment is a color liquid crystal display apparatus of the transmission type which includes a color liquid crystal display panel 110 and a backlight apparatus 140 which illuminates the color liquid crystal display panel 110 from the back side and wherein the backlight apparatus 140 includes, as a light source section, a plurality of light emitting diode units LEDU11 to LEDU44 provided corresponding to optical regions A11 to A44 which mix light fluxes of different colors from light emitting diodes 21R, 21G and 21B of the colors. Then, the amounts of light of the colors from the light emitting diode units LEDU11 to LEDU44 are successively and individually detected by light detecting light introducing plates each in the form of an optically transparent elongated plate which are disposed so as to traverse the regions A11 to A44 and have light pickup portions W11 to W44 provided corresponding to the regions A11 to A44, respectively. The backlight driving control section 250 controls the magnitude of driving current to be supplied to the light emitting diodes 21R, 21G and 21B of the colors of the light emitting diode units LEDU11 to LEDU44 based on the light amount detection signals from the light amount sensor sections LS1 to LS4, respectively.

Accordingly, in the present color image display apparatus 100, when the backlight apparatus 140 is to be driven in a unit of one of the regions A11 to A44, appearance of irregularities in color of a display image caused by displacement of the light amount balance among the regions A11 to A44 can be prevented. It is to be noted that, in the backlight apparatus 140, since light introduced from the regions A11 to A44 through the light detecting light introducing plates LGP1 to LGP4 disposed so as to traverse the regions A11 to A44 is detected by the light amount sensor sections LS1 to LS4 to individually control the light amount balance of the light of the colors in the regions A11 to A44, the overall area of the rear side of the backlight apparatus 140 can be used for cooling.

Figure 9A:
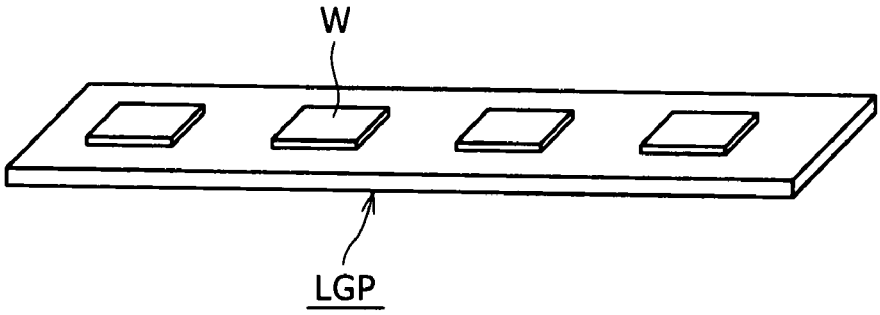
FIGS. 9A, 9B and 10 are perspective views showing different examples of the shape of the light pickup portion of the light detecting light introducing plate provided in the backlight apparatus.
Figure 9B:
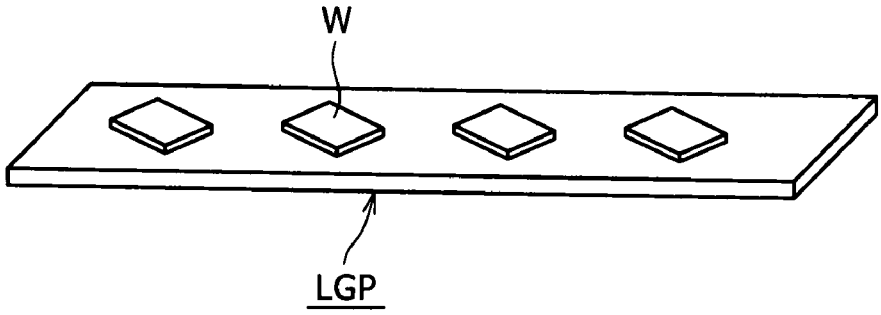
Figure 10:
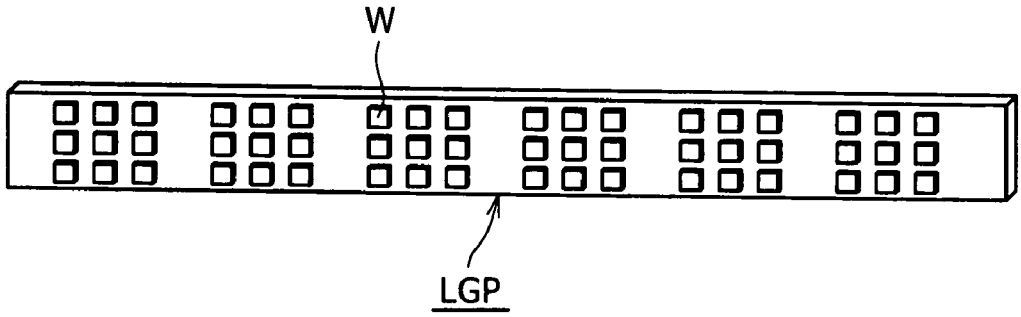

It is to be noted here that, while the light pickup portions W11 to W44 of the light detecting light introducing plates LGP1 to LGP4 in the color image display apparatus 100 described above are formed in a shape of a concave portion, it is only necessary for the light pickup portion W to have an upright face which is provided uprightly so as to intersect with the longitudinal direction of the light detecting light introducing plate LGP and does not satisfy an angular condition for the total reflection. Further, the upright face which does not satisfy the angular condition for the total reflection may be provided in an inclined relationship by 45 degrees with respect to and an intersecting relationship with the longitudinal direction of the light detecting light introducing plates LGP1 to LGP4 as seen in FIG. 9B.

Further, while the light pickup portions W11 to W44 of the light detecting light introducing plates LGP1 to LGP4 in the color image display apparatus 100 are provided in a one-by-one corresponding relationship to the regions A11 to A44, it is otherwise possible to provide a plurality of light pickup portions W for each of the regions to enhance the light pickup efficiency.

Further, while the light pickup portions W11 to W44 of the light detecting light introducing plates LGP1 to LGP4 in the color image display apparatus 100 are provided in a one-by-one corresponding relationship to the regions A11 to A44 so that the light amount balance is controlled for each of the regions, it is otherwise possible to provide one light pickup portion W for each predetermined number of regions so that the light amount balance is controlled for each predetermined number of regions.

Figure 11:
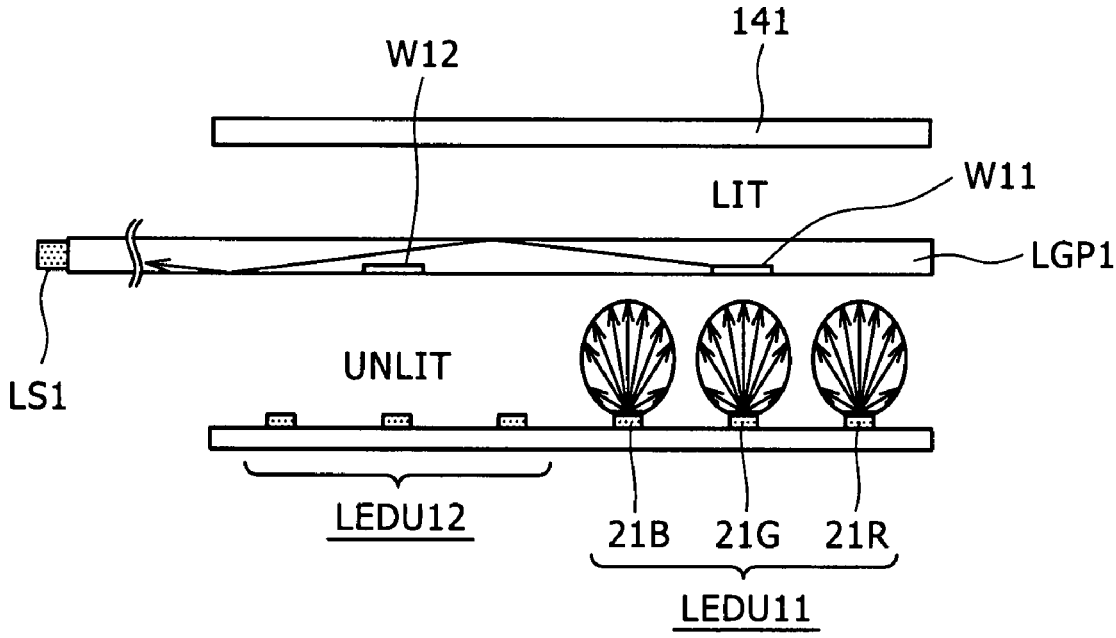
FIG. 11 is a partial vertical sectional view showing a structure of the backlight apparatus wherein a partition wall in the housing section is eliminated.

Further, while the light emitting diode units LEDU11 to LEDU44 in the color image display apparatus 100 are provided individually in the regions A11 to A44 formed by partitioning the inside of the housing section 120 of the backlight apparatus 140 by means of the partition walls 121, it is otherwise possible to dispose the light emitting diode units LEDU11 to LEDU44 without the partition walls 121 as seen in FIG. 11.

Figure 12:
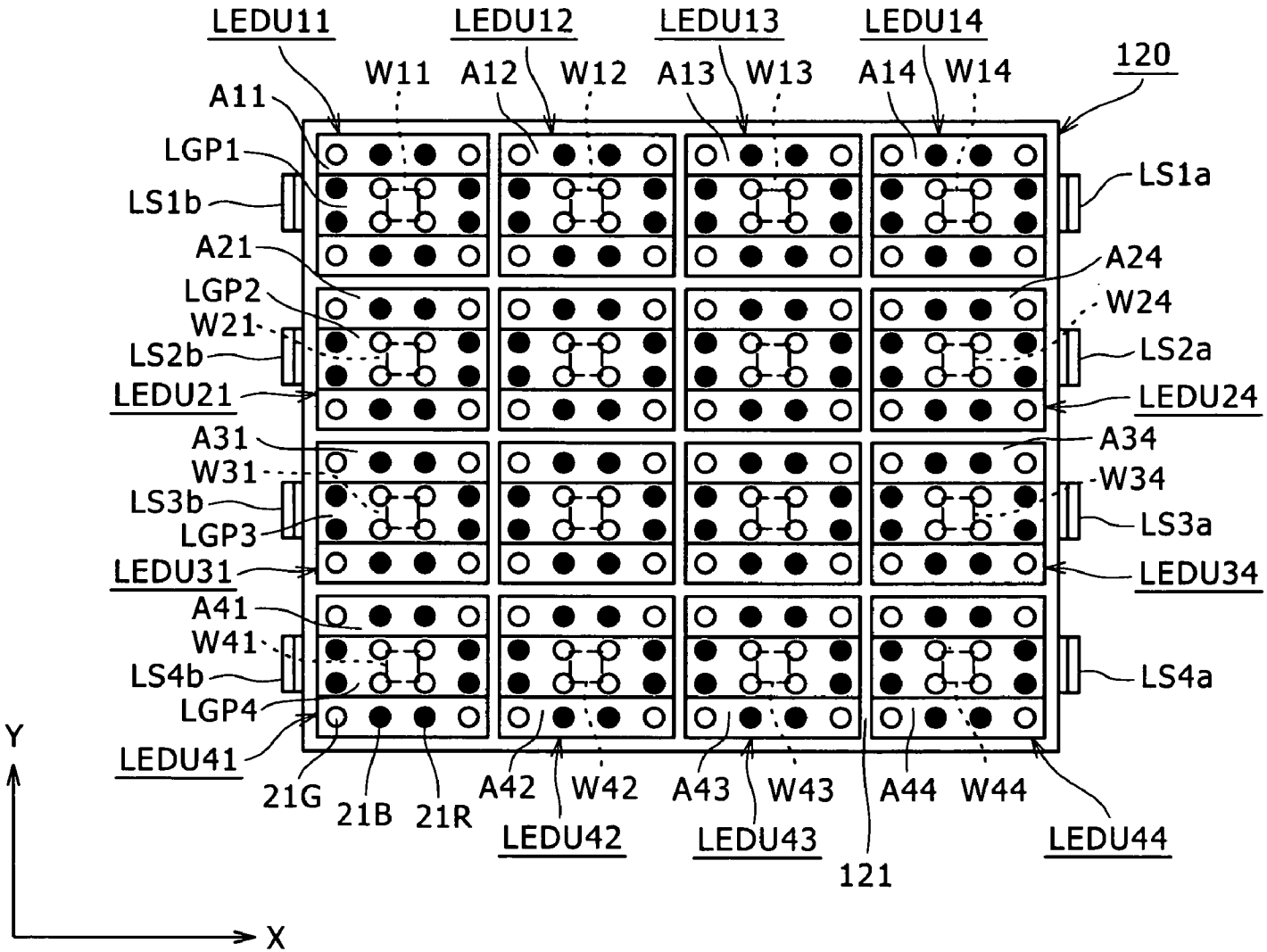
FIG. 12 is a plan view showing a configuration of part of a backlight apparatus wherein light amount sensor elements are provided on the opposite end faces of the light detecting light introducing plate in the longitudinal direction and successively detect the light amounts of different colors in individual regions.

Furthermore, while the light amounts of the colors of the light emitting diode units LEDU11 to LEDU44 in the color image display apparatus 100 are detected by the light amount sensor sections LS1 to LS4 provided on the end faces on one end in the longitudinal direction of the light detecting light introducing plates LGP1 to LGP4, respectively, it is otherwise possible to provide light amount sensor sections LS1*a* and LS1*b* to LS4*a* and LS4*b* on the opposite ends in the longitudinal direction of the light detecting light introducing plates LGP1 to LGP4 as seen in FIG. 12 such that the light amounts of the colors in the regions A11 to A44 are successively detected and the light amount balances of light of the colors in the regions A11 to A44 are individually controlled based on light amount detection signals from the light amount sensor sections LS1*a* and LS1*b* to LS4*a* and LS4*b*, respectively.

Since the light fluxes of the colors picked up through the light pickup portions W11 to W44 of the light detecting light introducing plates LGP1 to LGP4 are mixed while they are introduced through the light detecting light introducing plates LGP1 to LGP4, the backlight driving control section 250 controls the light amount sensors of the light amount sensor sections LS1*a* to LS4*a* and LS1*b* to LS4*b* so that each of the light amount sensors detects a plurality of light fluxes of different colors emitted from those of the light emitting diode units LEDU11 to LEDU44 which correspond to those of divisional portions obtained by dividing the associated light detecting light introducing plate LGP1 to LGP4 equally into two portions in the longitudinal direction which are positioned on the remote side from the light amount sensor, and then controls the light amount balances of the light fluxes to be emitted from the light emitting diode units LEDU11 to LEDU44 based on detection outputs of the light amount sensor sections LS1*a* to LS4*a* and LS1*b* to LS4*b*.

In particular, the light amount balance of the light emitting diode units LEDU11 and LEDU12 is controlled based on the detection output of the light amount sensor section LS1*a* provided on the right end face of the light detecting light introducing plate LGP1. Meanwhile, the light amount balance of the light emitting diode units LEDU13 and LEDU14 is controlled based on the detection output of the light amount sensor section LS1*b* provided on the left end face of the light detecting light introducing plate LGP1.

Meanwhile, the light amount balance of the light emitting diode units LEDU21 and LEDU22 is controlled based on the detection output of the light amount sensor section LS2*a* provided on the right end face of the light detecting light introducing plate LGP2. Meanwhile, the light amount balance of the light emitting diode units LEDU23 and LEDU24 is controlled based on the detection output of the light amount sensor section LS2*b* provided on the left end face of the light detecting light introducing plate LGP2.

Further, the light amount balance of the light emitting diode units LEDU31 and LEDU32 is controlled based on the detection output of the light amount sensor section LS3*a* provided on the right end face of the light detecting light introducing plate LGP3. Meanwhile, the light amount balance of the light emitting diode units LEDU33 and LEDU34 is controlled based on the detection output of the light amount sensor section LS3*b* provided on the left end face of the light detecting light introducing plate LGP3.

Furthermore, the light amount balance of the light emitting diode units LEDU41 and LEDU42 is controlled based on the detection output of the light amount sensor section LS4*a* provided on the right end face of the light detecting light introducing plate LGP4. Meanwhile, the light amount balance of the light emitting diode units LEDU43 and LEDU44 is controlled based on the detection output of the light amount sensor section LS4*b* provided on the left end face of the light detecting light introducing plate LGP4.

Figure 13:
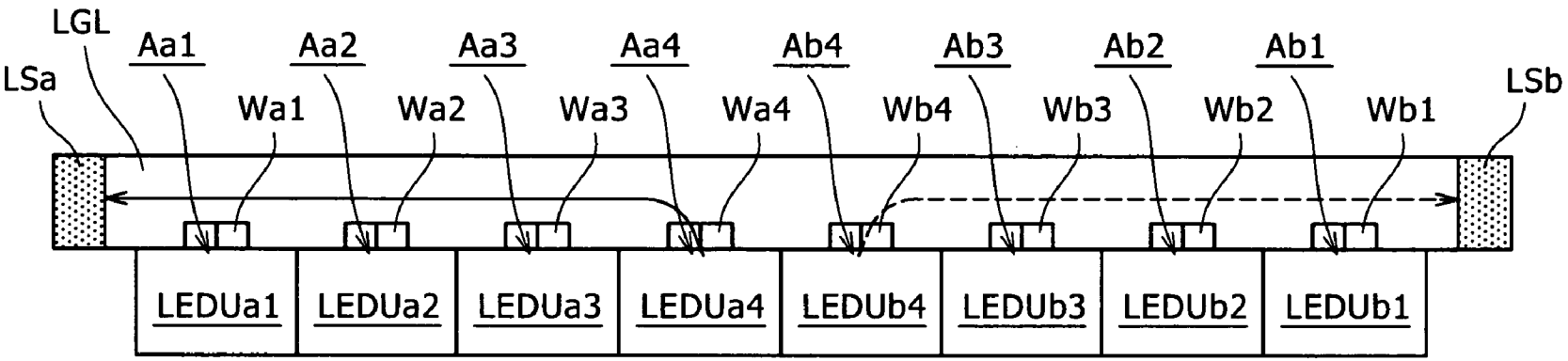
FIG. 13 is a sectional view showing a configuration of part of a backlight apparatus wherein light amount sensor elements are provided on the opposite end faces of the light detecting light introducing plate in the longitudinal direction and detect the light amounts of different colors in individual regions.

It is to be noted that, since the light fluxes of the colors picked up through the light pickup portions W are attenuated when they pass a light detecting light introducing plate LGP in the form of an elongated plate, in order to detect the light amounts at a high sensitivity and control the light amount balance, it is preferable to provide light amount sensor sections LSa and LSb at the opposite end portions of the light detecting light introducing plate LGP as seen in FIG. 13 such that light emitted from the light emitting diode units LEDUa1 to LEDUa4 is detected by the light amount sensor section LSa while light emitted from the light emitting diode units LEDUb1 and LEDUb4 is detected by the light amount sensor section LSb.

In particular, the backlight driving control section 250 controls the light amount sensors of the light amount sensor sections LSa and LSb provided at the opposite ends of the light detecting light introducing plate LGP in the longitudinal direction so that each of the light amount sensors detects light fluxes emitted from those of the light emitting diode units LEDUa1 to LEDUa4 and LEDUb1 to LEDUb4 which correspond to those of divisional portions obtained by dividing the light detecting light introducing plate LGP equally into two portions in the longitudinal direction which are positioned on the near side from the light amount sensor, that is, light fluxes from optical regions Aa1 to Aa4 and Ab1 to Ab4 grouped for each arbitrary number of monochromatic light sources, thereby to successively detect the light fluxes emitted from the optical regions Aa1 to Aa4 and Ab1 to Ab4 by means of the light amount sensors of the colors at the light amount sensor sections LSa and LSb, and then controls the light amount balances of the light fluxes to be emitted from the monochromatic light sources grouped individually for the optical regions Aa1 to Aa4 and Ab1 to Ab4 based on the detection outputs of the light amount sensor sections. By this, light amount can be performed and the light amount balance can be controlled in high sensitivity.

Further, since the detection sensitivity of the light amount sensor sections LSa and LSb to light fluxes emitted individually from the light emitting diode units LEDUa1 to LEDUa4 and LEDUb1 to LEDUb4, that is, to light fluxes emitted from the optical regions Aa1 to Aa4 and Ab1 to Ab4 grouped for each arbitrary number of monochromatic light sources, varies depending upon the distance from the light amount sensor sections LSa and LSb to the optical regions Aa1 to Aa4 and Ab1 to Ab4, light pickup portions Wa1 to Wa4 and Wb1 to Wb4 whose light pickup efficiency increases as the distance from the light amount sensor sections LSa and LSb increases should be provided for the individual optical regions Aa1 to Aa4 and Ab1 to Ab4. By this, the detection sensitivity can be made fixed to control the light amount balance uniformly.

The light pickup efficiency of the light pickup portions Wa1 to Wa4 and Wb1 to Wb4 can be varied by varying the shape of the light pickup portions such as the size of the light pickup portions, the depth of the light pickup portions where the light pickup portions have a concave shape or the height of the light pickup portions where the light pickup portions have a convex shape, the number of such light pickup portions or the like.

Figure 14:
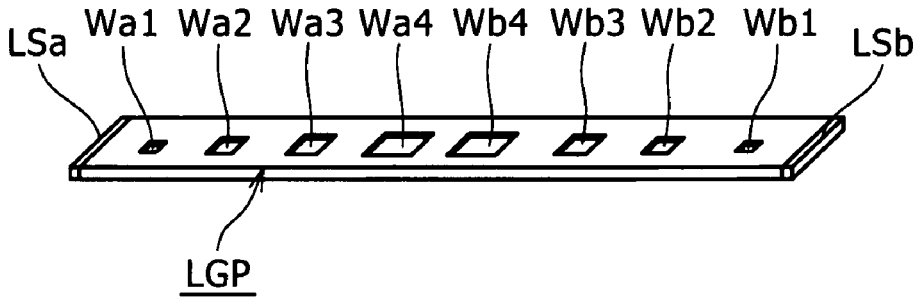
FIG. 14 is a perspective view showing an example of the shape of light pickup portions of a light detecting light introducing plate provided in a backlight apparatus such that the color amounts of different colors in individual regions are detected uniformly by light amount sensor sections provided on the opposite end faces of the light detecting light introducing plate in the longitudinal direction.

The detection sensitivity can be made uniform, for example, by providing such light pickup portions Wa1 to Wa4 and Wb1 to Wb4 whose size is varied among the optical regions Aa1 to Aa4 and Ab1 to Ab4 as seen in FIG. 14 to make the light pickup efficiencies different from each other.

Figure 15:
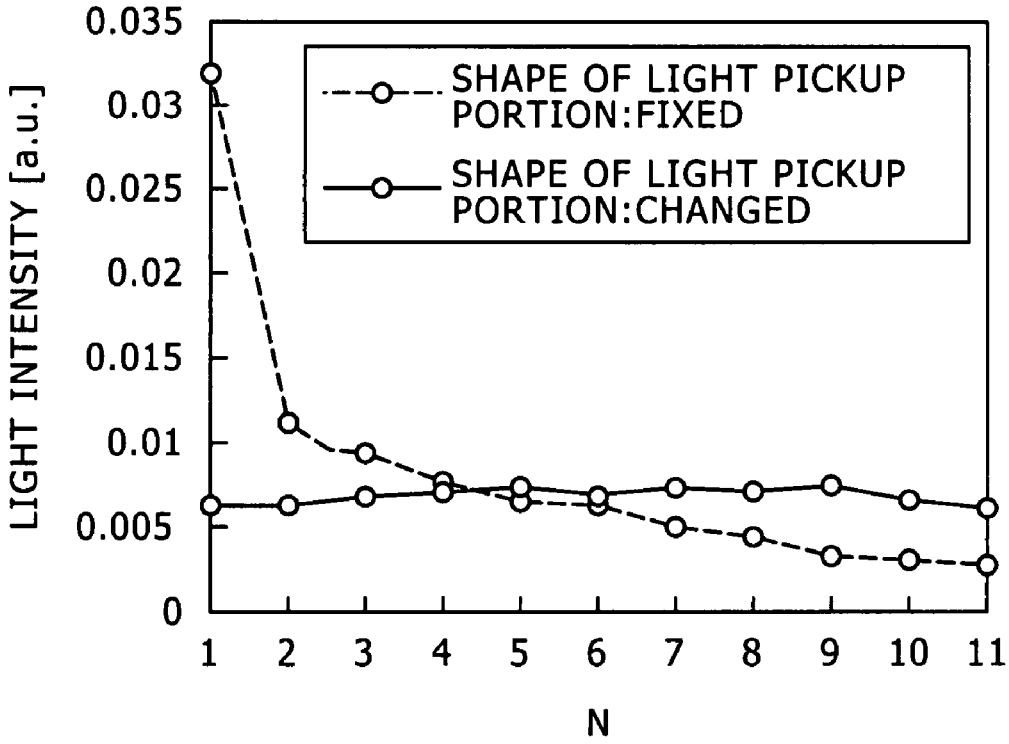
FIG. 15 is a characteristic diagram illustrating a result of actual measurement of the intensity of light from N optical regions detected by the light amount sensor elements.

Here, a result of actual measurement of the intensity of light where light is picked up from N optical regions through light pickup portions and introduced to a light amount sensor section through a light detecting light introducing plate so that it is detected by the light amount sensor section is illustrated in FIG. 15. FIG. 15 illustrates an actual measurement result F1 where the size of the light pickup portion is varied among different optical regions to make the light pickup efficiencies different from each other and another actual measurement result F2 where the light pickup efficiencies are made equal to each other. In FIG. 15, the axis of abscissa indicates the number of each of the N optical regions where the number of the optical region nearest to the optical amount sensor section is set to "1", and the axis of ordinate indicates the intensity of light detected by the light amount sensor section.

Figure 16:
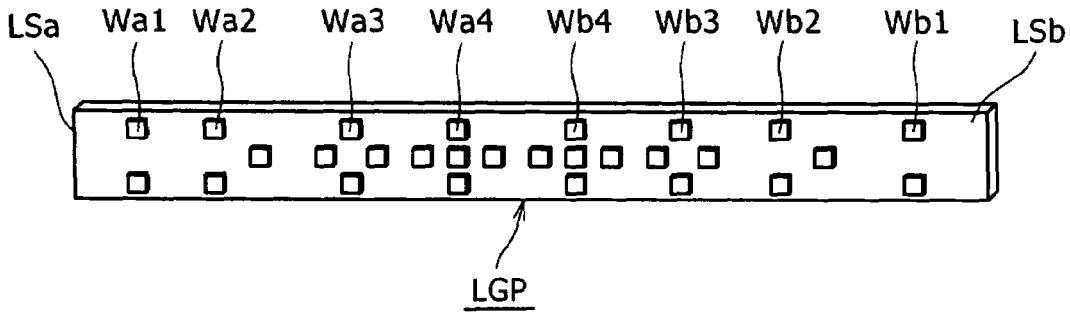
FIG. 16 is a perspective view showing another example of the shape of light pickup portions of a light detecting light introducing plate provided in a backlight apparatus such that the color amounts of different colors in individual regions are detected uniformly by light amount sensor sections provided on the opposite end faces of the light detecting light introducing plate in the longitudinal direction.

Also where such light pickup portions Wa1 to Wa4 and Wb1 to Wb4 whose light pickup efficiencies are made different from each other by changing the number of light pickup portions among the different optical regions Aa1 to Aa4 and Ab1 to Ab4 as seen in FIG. 16, the detection sensitivity can be uniformized.

While a preferred embodiment of the present invention has been described using specific terms, such description is for illustrative purpose only, and it is to be understood that changes and variations may be made without departing from the spirit or scope of the following claims.

The invention claimed is:

1. A backlight apparatus for illuminating a color display panel from the back side, comprising:

a light source section including a composite light source configured to mix light fluxes of different colors from a plurality of monochromatic light sources and irradiate the mixed light upon said color display panel and having a plurality of optical regions grouped for each arbitrary number of said monochromatic light sources;

a light detecting light introducing plate in the form of an optically transparent elongated plate disposed so as to traverse the optical regions of said light source section and having at least one light pickup portion provided thereon corresponding to each of the optical regions;

a plurality of light amount sensors for the individual colors provided at least on one of the opposite end faces of said light detecting light introducing plate in the longitudinal direction; and control means for successively detecting the light in the individual optical regions using said color light sensors for the individual colors and controlling the light amount balance of the light of the colors emitted from the monochromatic light sources grouped for the individual optical regions based on detection outputs of said light amount sensors for the colors.

2. The backlight apparatus according to claim 1, wherein said light pickup portion has an upright face provided uprightly so as to intersect with the longitudinal direction of said light detecting light introducing plate and so as not to satisfy an angular condition for the total reflection.

3. The backlight apparatus according to claim 2, wherein said light pickup portion is formed in a concave shape.

4. The backlight apparatus according to claim 2, wherein said light pickup portion is formed in a convex shape.

5. The backlight apparatus according to claim 1, wherein said light pickup portion is provided one for each predetermined number of the optical regions.

6. The backlight apparatus according to claim 1, wherein said light pickup portion is provided for each of the optical regions.

7. The backlight apparatus according to claim 1, wherein said light pickup portion is provided by a plural number for one of the optical regions.

8. The backlight apparatus according to claim 1, further comprising a plurality of partition walls configured to separate the optical regions from each other, said light detecting light introducing plate being provided so as to extend through said partition walls.

9. The backlight apparatus according to claim 1, further comprising a plurality of light amount sensors for the colors provided in the light amount sensor sections which are provided at the opposite ends of said light detecting light introducing plate in the longitudinal direction.

10. The backlight apparatus according to claim 1, wherein said control means controls the light amount sensors provided in light amount sensor sections provided at the opposite ends of said light detecting light introducing plate in the longitudinal direction so that each of the light amount sensors detects light of a plurality of colors emitted from those of the grouped monochromatic light sources which correspond to those of divisional portions obtained by dividing said light detecting light introducing plate equally into two portions in the longitudinal direction which are positioned on the remote side from the light amount sensor, thereby to successively detect the light emitted from the optical regions by means of the light amount sensors of the colors, and then controls the light amount balances of the light of the colors to be emitted from the monochromatic light sources grouped individually for the optical regions based on the detection outputs of the light amount sensor sections of the colors.

11. The backlight apparatus according to claim 1, wherein said control means controls the light amount sensors provided at the opposite ends of said light detecting light introducing plate in the longitudinal direction so that each of the light amount sensors detects light of a plurality of colors emitted from those of the grouped monochromatic light sources which correspond to those of divisional portions obtained by dividing said light detecting light introducing plate equally into two portions in the longitudinal direction which are positioned on the near side from the light amount sensor, thereby to successively detect the light emitted from the optical regions by means of the light amount sensors of the colors, and then controls the light amount balances of the light of the colors to be emitted from the monochromatic light sources grouped individually for the optical regions based on the detection outputs of the light amount sensor sections of the colors.

12. The backlight apparatus according to claim 1, wherein the light pickup portions provided in the optical regions of said light detecting light introducing plate are formed such that the light pickup efficiency increases as the distance from each of said light amount sensors for the colors increases.

13. The backlight apparatus according to claim 1, wherein the light pickup portions provided in the optical regions have different shapes to make the light pickup efficiencies different from each other among the optical regions.

14. The backlight apparatus according to claim 1, wherein the light pickup portions are provided in the optical regions such that the numbers of the light pickup portions included in the optical portions are made different from each other.

15. A color image display apparatus, comprising:

a color display panel; and a backlight apparatus configured to illuminate said color display panel from the back side;

said backlight apparatus including a light source section having a composite light source configured to mix light fluxes of different colors from a plurality of monochromatic light sources and irradiate the mixed light upon said color display panel and having a plurality of optical regions grouped for each arbitrary number of said monochromatic light sources, a light detecting light introducing plate in the form of an optically transparent elongated plate disposed so as to traverse the optical regions of said light source section and having at least one light pickup portion provided thereon corresponding to each of the optical regions, a plurality of light amount sensors for the individual colors provided at least on one of the opposite end faces of said light detecting light introducing plate in the longitudinal direction, and control means for successively detecting the light in the individual optical regions using said color light sensors for the individual colors and controlling the light amount balance of the light of the colors emitted from the monochromatic light sources grouped for the individual optical regions based on detection outputs of said light amount sensors for the colors.

* * * * *